US005899449A

United States Patent [19]

Acquaviva et al.

[11] Patent Number: 5,899,449

[45] Date of Patent: May 4, 1999

[54] TOP VACUUM CORRUGATION FEEDER WITH ARTICULATING SUCTION FINGERS

[75] Inventors: Thomas Acquaviva, Penfield; William Brant, Rochester, both of N.Y.

[73] Assignee: Xerox Corporation, Stamford, Conn.

[21] Appl. No.: 08/784,634

[22] Filed: Jan. 21, 1997

[51] Int. Cl.[6] ..... B65H 5/10

[52] U.S. Cl. ..... 271/12; 271/93; 271/107; 271/108

[58] Field of Search ..... 271/5, 6, 11, 12, 271/93, 94, 98, 105, 106, 107, 108

[56] References Cited

U.S. PATENT DOCUMENTS

| | | | |
|---|---|---|---|
| Re. 20,862 | 9/1938 | Harrold | 271/11 |
| 3,384,250 | 5/1968 | Vanhentenrijk et al. | 271/94 |
| 3,409,149 | 11/1968 | Graux | 271/11 |
| 4,382,593 | 5/1983 | Beran et al. | 271/108 |
| 4,421,306 | 12/1983 | Muka | 271/5 |
| 4,589,647 | 5/1986 | Roller | 271/94 |
| 4,678,176 | 7/1987 | Roller | 271/94 |
| 4,887,805 | 12/1989 | Herbert et al. | 271/94 |
| 5,088,713 | 2/1992 | Hayashi | 271/3.1 |
| 5,290,022 | 3/1994 | Sabatier et al. | 271/94 |

FOREIGN PATENT DOCUMENTS

| | | | |
|---|---|---|---|
| 0231329 | 9/1990 | Japan | 271/11 |

OTHER PUBLICATIONS

Brook et al, Sheet Separator with Bolt Transport Xerox Discharge Journal, vol. 4 No. 1, pp. 55–56, Feb. 1979.

*Primary Examiner*—H. Grant Skaggs
*Attorney, Agent, or Firm*—William A. Henry, II

[57] ABSTRACT

A top vacuum corrugation feeder includes articulating suction fingers to assist in raising the top sheet of a stack of sheets to the feedhead of the vacuum corrugation feeder. The suction fingers are rotated down from their interleaved position between feed belts to contact the top sheet in the sheet stack and raises the top sheet to the feed belts. As a result, the feeder can handle heavy sheets, curled sheets, and sheets which are edge welded.

10 Claims, 3 Drawing Sheets

TOP VACUUM CORRUGATION FEEDER WITH ARTICULATING SUCTION FINGERS

BACKGROUND OF THE INVENTION

This invention relates generally to a printing machine, and more particularly, concerns an improved copy sheet feeder for such a machine.

High speed xerographic reproduction machines and printers, such as, the Xerox DocuTech® 135 and Xerox® 5090 produce copies at a rate in excess of several thousand copies per hour, and therefore, the need for reliable high speed feeding of copy sheets is essential. Presently, some copiers and printers use top vacuum corrugation feeders with a front air knife. In this system, a vacuum plenum with a plurality of friction belts are arranged to run over the vacuum plenum is placed at the top of a stack of sheets in a supply tray. The vacuum system is sized such that there is high open port flow to be able to acquire sheets, but a lower closed port pressure as to not damage or smear the sheets. At the front of the stack, an air knife is used to inject air into the stack to raise the top several sheets from the remainder of the stack. The air pressure actually required to physically separate sheets 1 and 2 from the stack can vary greatly dependent on the basis weight, static conditions, curl conditions, and edge welding properties of the paper. The air knife, however, is designed based on a single air pressure setting for the air knife assembly. This air pressure must be adequate for basis weights from 56 gsm to 200 gsm. This is usually a mutually exclusive event. Therefore, a basic latitude issue arises as to the air pressure requirements for heavy versus lightweight paper. In addition, sheets which are curled in the upward direction, or a stack of sheets with edge welds, present acquisition difficulties. As a result, either the latitude is limited, or a much longer acquisition time is required. A long acquisition time implies that the feed rate is limited. Increasing the vacuum level means that the feeder may cost more and may be noisy. In operation, air is injected by the air knife toward the stack to separate the top sheet, the vacuum pulls the separated sheet up and acquires it. Following acquisition, the belt transport drives the sheet forward off the stack of sheets. In this configuration, separation of the next sheet cannot take place until the top sheet has cleared the stack. In this type of feeding system every operation takes place in succession or serially, and therefore, the feeding of subsequent sheets cannot be started until the feeding of the previous sheet has been completed. In addition, in this type of system, the air knife may cause the second sheet to vibrate independent of the rest of the stack in a manner referred to as "flutter". When the second sheet is in this situation, if it touches the top sheet, it may tend to creep forward slightly with the top sheet. The air knife then may force the second sheet against the first sheet causing a shingle or double feeding of sheets.

Also, some current top and bottom vacuum corrugation feeders utilize a valved vacuum feedhead, e.g., U.S. Pat. No. 4,269,406 which is included herein by reference. At the appropriate time during the feed cycle, the valve is actuated establishing a flow and hence a negative pressure field over the stack top or bottom if a bottom vacuum corrugation feeder is employed. This field causes the movement of the top sheet(s) to the vacuum feedhead where the sheet is then transported to the takeaway rolls. Once the sheet lead edge is under control of the takeaway rolls, the vacuum is shut off. The trail edge of this sheet exiting the feedhead area is the criteria for again activating the vacuum valve for the next feed. While these feeders are successful to some extent in feeding copy sheets at high rates of speed, there is still a need for a more reliable high speed feeder that is lower in cost, lower in noise level, and with increased feeder latitude and reduced shutdown rate than has been practiced heretofore.

PRIOR ART

A top vacuum corrugation feeder is shown in U.S. Pat. No. 4,887,805 that employs a belt coast control member that controls the precise stopping position of vacuum belts that surround a vacuum feedhead in order to minimize multifeeding of sheets from a stack. U.S. Pat. No. 5,088,713 shows a bottom sheet refeeding document handler that employs a vacuum chamber with an air knife and retard mechanism to separate the bottommost sheet in a stack from the remainder to the stack.

SUMMARY OF THE INVENTION

Accordingly, in answer to the above-mentioned high speed sheet feeder deficiencies, a top sheet feeding apparatus is disclosed that includes a sheet support tray adapted to support a stack of copy sheets and a feedhead that includes a vacuum chamber adapted to have a portion thereof extend over the front of the stack of sheet when sheets are placed in the support tray. The vacuum plenum has a plurality of perforated belts mounted on drive and idler rolls and entrained therearound for individually transporting copy sheets attached thereto by vacuum pressure from the vacuum plenum in a predetermined direction. A plurality of articulating suction fingers are positioned between the plurality of perforated belts and adapted to lift the topmost sheet in the sheet stack up to the plurality of perforated belts.

BRIEF DESCRIPTION OF THE DRAWINGS

For a better understanding of the invention, as well as other objects and further features thereof, reference is made to the following drawings.

DETAILED DESCRIPTION OF THE INVENTION

Figure 3:
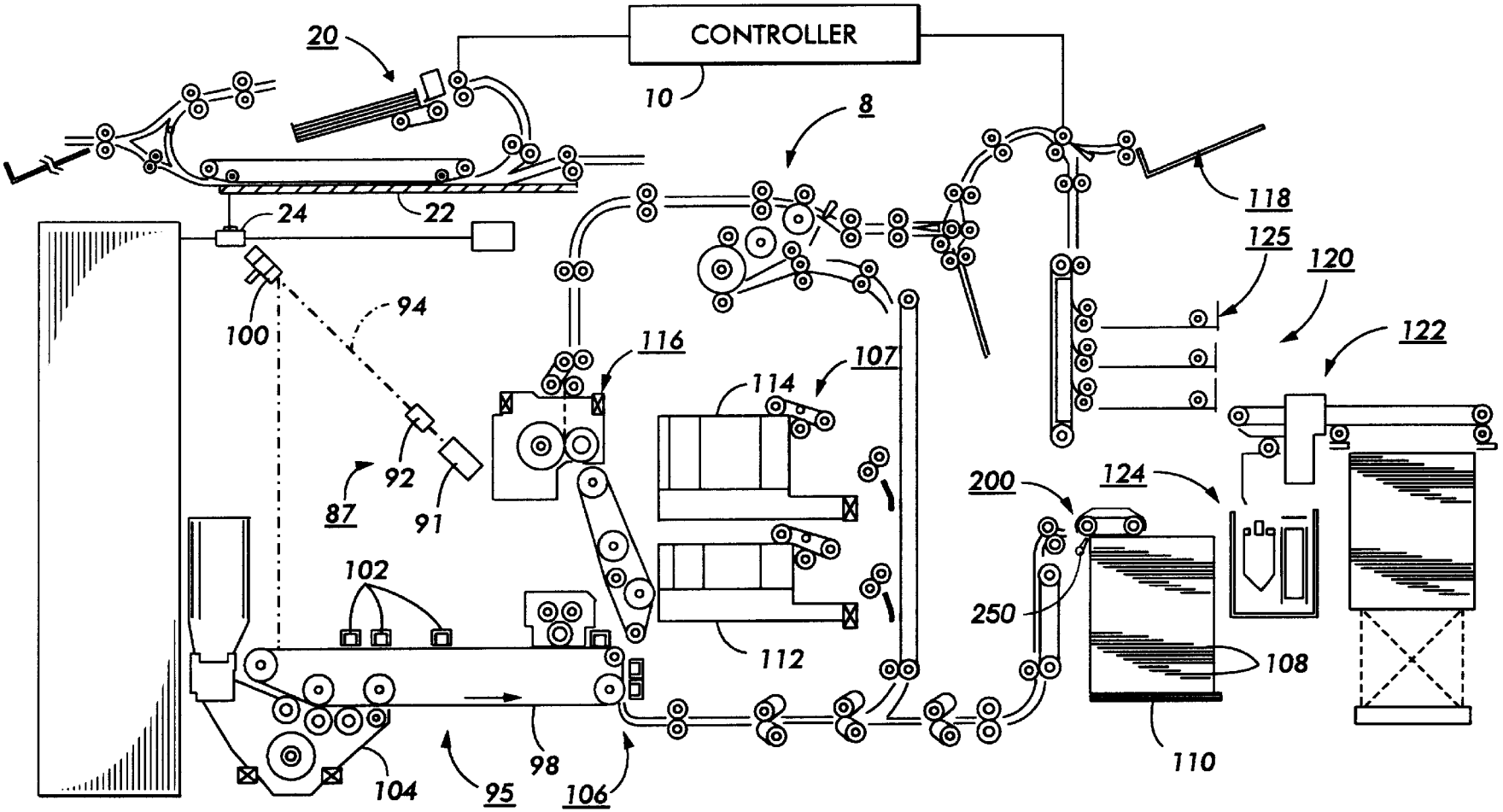
FIG. 3 is a schematic side view of a copier/printer that incorporates the improved sheet feeder of the present invention. While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Reference is now made to the drawings where the showings are for the purpose of illustrating a preferred embodiment of the invention and not for limiting same, the various processing stations employed in the printing machine illustrated in FIG. 3 will be briefly described.

Referring now to FIG. 3, printer section 8 comprises a laser type printer and for purposes of explanation is separated into an original document presentation system 20 that presents documents to platen 22, an electronic document imaging system 24, a Raster Output Scanner (ROS) section 87, Print Module Section 95, Paper Supply section 107, and Finisher 120. ROS 87 has a laser, the beam of which is split into two imaging beams 94. Each beam 94 is modulated in accordance with the content of an image signal input by acousto-optic modulator 92 to provide dual imaging beams 94. Beams 94 are scanned across a moving photoreceptor 98 of Print Module 95 by the mirrored facets of a rotating polygon 100 to expose two image lines on photoreceptor 98 with each scan and create the latent electrostatic images represented by the image signal input to modulator 92. Photoreceptor 98 is uniformly charged by corotrons 102 at a charging station preparatory to exposure by imaging beams 94. The latent electrostatic images are developed by developer 104 and transferred at a transfer station 106 to a print media 108 delivered by Paper Supply section 107. Media 108, as will appear, may compromise any of a variety of sheet sizes, types and colors. For transfer, the print media is brought forward by servo controlled rolls in timed registration with the developed image on photoreceptor 98 from either a main paper tray 110 or from auxiliary paper trays 112, or 114. The developed image transferred to the print media 108 is permanently fixed or fused by fuser 116 and the resulting prints discharged to either output tray 118, or to output collating trays in finisher 120. Finisher 120 includes a stitcher 122 for stitching (stapling) the prints together to form books, and a thermal binder 124 for adhesively binding the prints into books and a stacker 125.

The control of all machine functions, including all sheet feeding, is, conventionally, by the machine controller 10. Controller 10 is preferably a known programmable microprocessor, exemplified by the microprocessor disclosed in U.S. Pat. No. 4,166,558. The controller 10 conventionally controls all of the machine steps and functions described herein, and others, including the operation of the document feeder 20, all of the document and copy sheet deflectors or gates, the sheet feeder drives, the finisher, etc. The controller also conventionally provides for storage and comparison of the counts of the copy sheets, the number of documents recirculated in a document set, the desired number of copy sets and other selections and controls by the operator through the console or other panel of switches connected to the controller, etc. The controller is also programmed for time delays from correction control, etc. Conventional path sensors or switches may be utilized to help keep track of the position of the documents and the copy sheets and the moving components of the apparatus by connection to the controller. In addition, the controller variably regulates the various positions of the gates depending upon which mode of operation is selected.

Figure 1:
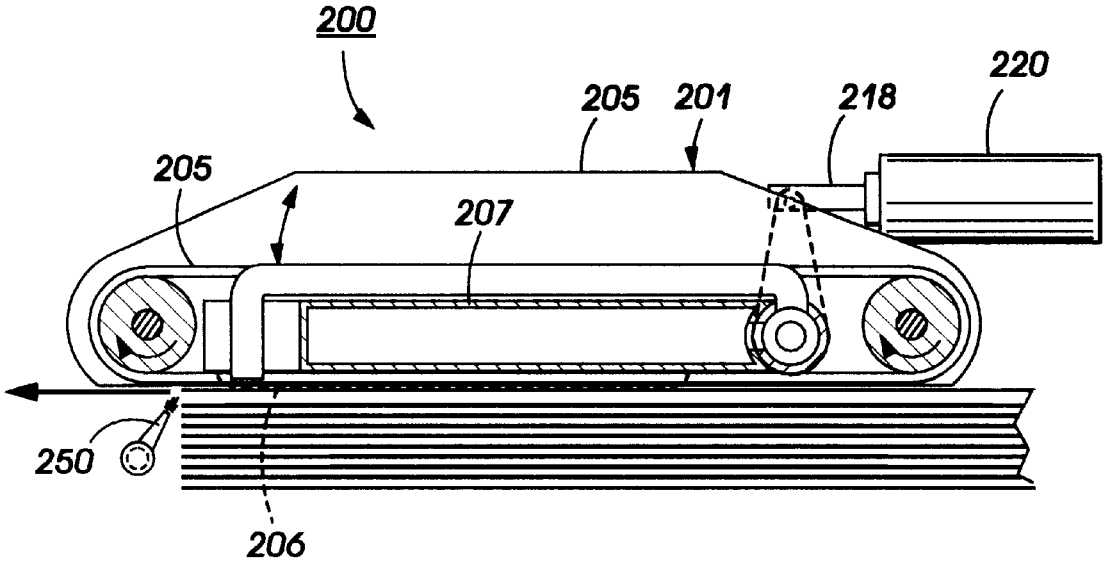
FIG. 1 is an enlarged, partial side view of the improved sheet feeder in accordance with the present invention.
Figure 2:
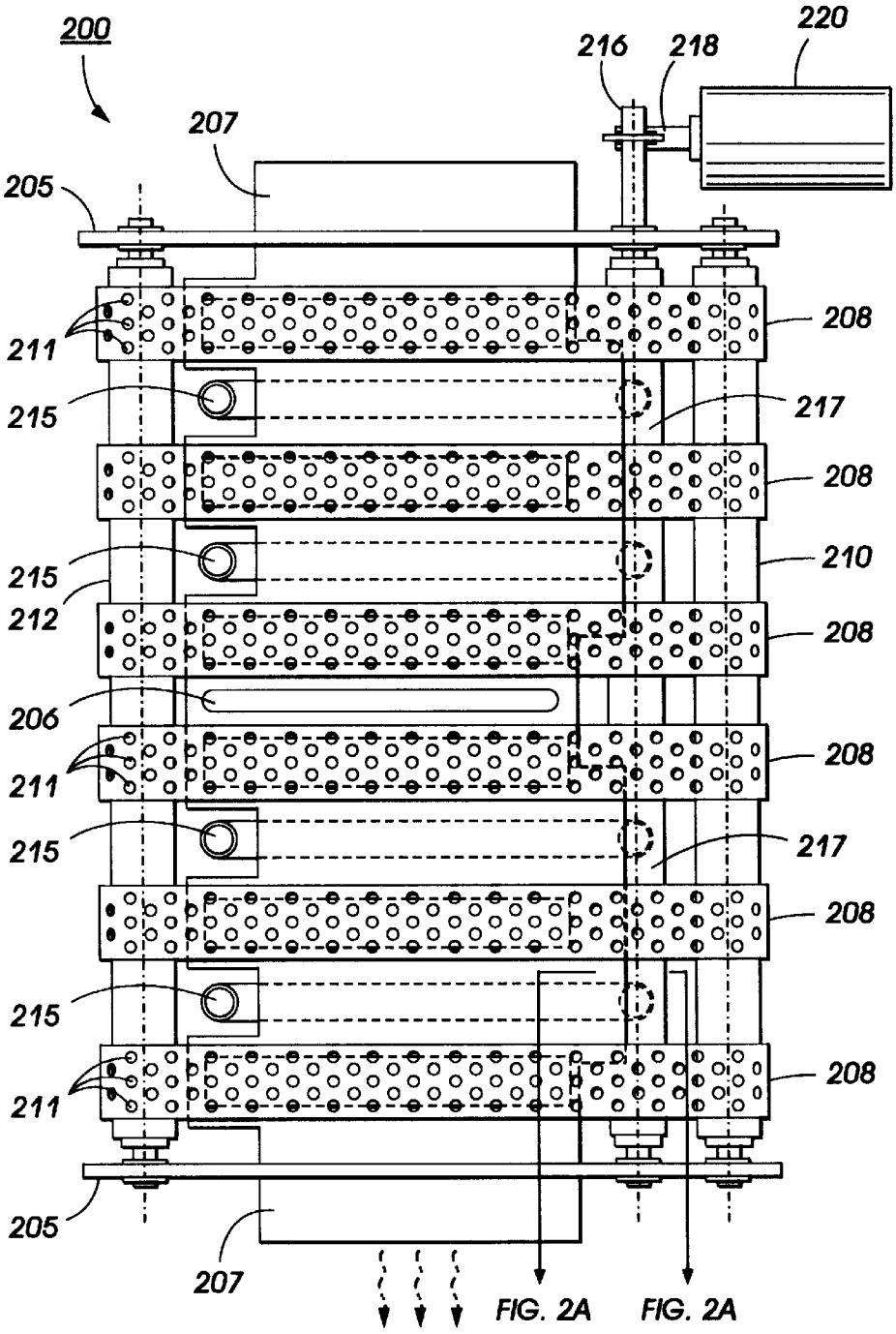
FIG. 2 is an enlarged, partial plan view of the sheet feeder of FIG. 1.
Figure 2A:
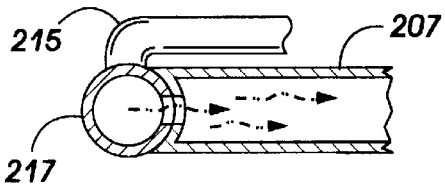
FIG. 2A is a partial side view of FIG. 2 taken along section line 2A—2A of FIG. 2.

Referring now to a particular aspect of the present invention, the copier/printer of FIG. 3 includes an improved copy sheet feeder 200 shown in FIGS. 1, 2 and 2A that feeds copy sheets at high speeds individually from main paper tray 110. Top vacuum corrugation copy sheet feeder 200 comprises a feedhead 201 that includes a housing 205 with a vacuum plenum 207 positioned over the front end of a copy sheets 108 supported in a tray 110. Belts 208 are entrained around drive rollers 212, idler roll 210, and vacuum plenum 207. Belts 208 could be made into a single belt, if desired. Perforations 211 are shown in FIG. 2 in belts 208 that allow a suitable vacuum source (not shown) to apply a vacuum through plenum 207 and belts 208 to acquire sheets 108 from a stack of sheets. Corrugation rail 206 is attached or molded into the underside and center of plenum 207 and causes sheets acquired by the vacuum plenum to bend during the corrugation so that if a second sheet is still sticking to the sheet having been acquired by the vacuum plenum, the corrugation will cause the second sheet to detack and fall back into the tray. However, it should be understood that multiple corrugations rails could be employed, if desired. A conventional air knife 250 is positioned to direct air pressure against sheets 108 in order to fluff and separate the sheets as vacuum pressure is applied to the sheets from vacuum plenum 207.

To extend the latitude of top vacuum corrugation feeder 200 and ensure that a wide variety of sheet sizes, weights and other conditions, such as up curled and edge welded, can be fed at high speeds, a series of low mass articulating fingers 215 are interleaved with belts 208. Fingers 215 are mounted on rotatable shaft 216 which in turn is connected through conventional linkage 218 to solenoid 220 that is adapted to rotate shaft 216 when the solenoid is actuated. Soft pads (not shown) are placed on the tips of the fingers in order to not damage copy sheets 108. Rotatable shaft 216 is positioned within a stationary tube 217 that is communicatingly connected to vacuum plenum 207. Rotation of shaft 216 in a clockwise direction away from sheets 108 cuts off vacuum flow to tube 217 as shown in FIG. 2A.

Articulating fingers 215 are used to help acquire the top sheet 108 from the sheet stack and raise it to the belts 208 of feedhead 201 when solenoid 220 is actuated. The fingers move down to the top of the stack in a rotary counter clockwise motion. Vacuum on the pads at the tip of the fingers acquire the top sheet near the lead edge, and raises it up to vacuum belts 208 of feedhead 201. Fingers 215 continue to rise between belts 208, but once they reach the bottom surface of the feedhead the vacuum under the belts takes over and holds the sheet in place. Separation of sheet 1 from sheet 2 and the remainder of the sheet stack has taken place with the assistance of air knife 250 and corrugator 206. Rotatable shaft 216 and stationary tube 217 form a rotary valve as shown in FIG. 2A that throttles the vacuum once the sucker fingers 215 bring the sheet to the level of the belts. This reduces drag on the sheet as it is being fed.

It should be now understood that an improved top vacuum corrugation feeder has been disclosed that includes fingers that pivot down against the top of a sheet stack and pull the top sheet in the stack back up against vacuum belts in order to improve reliability, decrease cost, decrease noise and decrease power requirements of the feeder.

The invention has been described with reference to the preferred embodiment. Obviously, modifications and alterations will occur to others upon a reading and understanding of the specification. It is intended to include all such modifications and alterations insofar as they come within the spirit and scope of the appended claims or the equivalent thereof.

What is claimed is:

1. A top sheet feeding apparatus, comprising:

a sheet support tray adapted to support a stack of copy sheets;

a feedhead including a vacuum plenum chamber positioned over a stack of copy sheets when copy sheets are placed in said support tray, said vacuum plenum chamber including a series of perforated belts mounted in a predetermined plane on drive and idler rolls and entrained therearound for individually transporting copy sheets in a predetermined direction attached thereto by vacuum pressure from said vacuum plenum;

at least two articulatable suction fingers interdigitated between said series of perforated belts and adapted to assist in lifting the top sheet in the sheet stack up to said perforated belts;

a stationary vacuum tube having a slit therein in communication with said vacuum plenum chamber and said suction fingers; and a solenoid connected to said suction fingers and adapted when actuated to lift said suction fingers and thereby cut off said communication of said vacuum plenum chamber with said stationary vacuum tube and said suction fingers.

2. The apparatus of claim 1, including a rotatable hollow shaft having a slit therein in communication with said vacuum plenum and said suction fingers and positioned inside said vacuum tube.

3. The apparatus of claim 2, wherein said solenoid when actuated initially moves said suction fingers down to the top of the stack in a rotary motion and subsequently raise said suction fingers upward away from the sheet stack.

4. The apparatus of claim 1, wherein said vacuum plenum includes a sheet corrugation member positioned in the center of its bottom surface.

5. A high speed top sheet feeding apparatus especially adapted to feed stiff sheets as well as flimsy sheets, comprising:

a sheet support tray adapted to support a stack of copy sheets;

a feedhead including a vacuum chamber positioned over said support tray and adapted to feed copy sheets therefrom, said vacuum chamber having a sheet corrugating means mounted in the center of its bottom surface and a series of perforated belts mounted on drive and idler rolls and entrained around said vacuum chamber for individually transporting copy sheets attached thereto by vacuum pressure from said vacuum chamber in a predetermined direction; an air knife positioned to apply air pressure to the front edge of a stack of sheet in said support tray;

at least two articulatable suction fingers interdigitated between said series of perforated belts and adapted to lift the top sheet in the sheet stack up to said perforated belts; and a rotatable hollow shaft connected to said at least two articulatable suction fingers, said rotatable hollow shaft when in a first position being in communication with said vacuum chamber and in a second position being out of communication with said vacuum chamber.

6. The apparatus of claim 5, wherein said articulatable suction fingers are adapted to be lifted upward beyond said predetermined plane of said perforated belts.

7. The apparatus of claim 5, including a solenoid connected to said rotatable hollow shaft and adapted when actuated to lift said suction fingers and rotate said rotatable hollow shaft between said first and second positions.

8. The apparatus of claim 7, including a vacuum tube having a slit therein in communication with said vacuum chamber, and wherein said rotatable shaft is positioned inside said vacuum tube.

9. The apparatus of claim 8, wherein said solenoid when actuated initially moves said suction fingers down to the top the stack in a rotary motion and subsequently raise said suction fingers upward away from the sheet stack.

10. The apparatus of claim 8, wherein said vacuum tube is stationary.

* * * * *